US006131666A

United States Patent [19]

Pelzel et al.

[11] Patent Number: 6,131,666

[45] Date of Patent: Oct. 17, 2000

[54] FIRE EXTINGUISHER

[75] Inventors: Wolfgang Pelzel, Nürnberg, Germany; Nader Riad, Cairo, Egypt

[73] Assignee: Bavaria Egypt (S.A.E.), Cairo, Egypt

[21] Appl. No.: 09/381,025

[22] PCT Filed: Mar. 10, 1998

[86] PCT No.: PCT/DE98/00725

§ 371 Date: Nov. 15, 1999

§ 102(e) Date: Nov. 15, 1999

[87] PCT Pub. No.: WO98/40125

PCT Pub. Date: Sep. 17, 1998

[30] Foreign Application Priority Data

Mar. 13, 1997 [DE] Germany ..... 197 10 300

[51] Int. Cl.[7] ..... A62C 37/00

[52] U.S. Cl. ..... 169/75; 169/88

[58] Field of Search ..... 169/30, 70, 75, 169/85, 88

[56] References Cited

U.S. PATENT DOCUMENTS

| | | | |
|---|---|---|---|
| 3,719,232 | 3/1973 | Gubela | 169/88 |
| 3,889,758 | 6/1975 | Dunn | 169/88 X |
| 4,862,968 | 9/1989 | Woodman | 169/75 |

FOREIGN PATENT DOCUMENTS

| | | |
|---|---|---|
| 0 004 981 A1 | 10/1979 | European Pat. Off. . |
| 0 298 022 A2 | 1/1989 | European Pat. Off. . |
| 0 507 664 A1 | 10/1992 | European Pat. Off. . |
| 2 629 720 | 10/1988 | France . |
| 37 03950 A1 | 11/1987 | Germany . |

*Primary Examiner*—Lesley D. Morris
*Attorney, Agent, or Firm*—Schweitzer Cornman Gross & Bondell LLP

[57] ABSTRACT

In a fire extinguisher comprising a container containing extinguishing agent and a holder for a propellent gas cartridge as well as an actuating mechanism, arranged between an actuating member (46) and a valve pin (22) of a valve controlling the release of the extinguishing agent which is acted upon by the propellent gas is a wedge-shaped safety element (48) so that when the safety element is withdrawn a propellent gas cartridge (18) is opened automatically by a push rod (24) disposed on the valve pin. This ensures that the container containing the extinguishing agent is acted upon by the propellent gas from the propellent gas cartridge (18) before the fire extinguisher is first actuated.

4 Claims, 1 Drawing Sheet

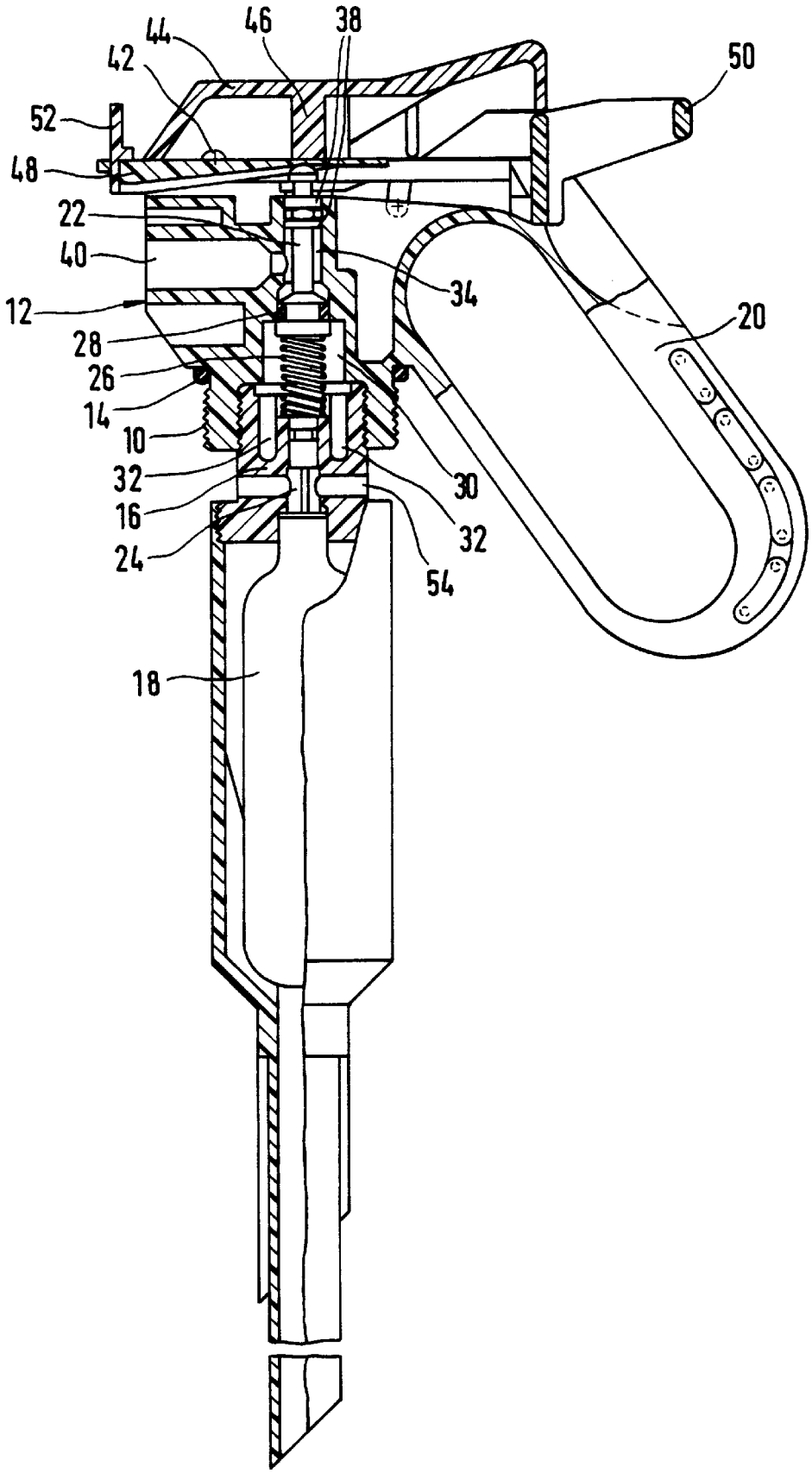
44
46
38
42
50
52
48
22
40
34
12
20
28
26
14
10
32
30
16
32
24
54
18

FIRE EXTINGUISHER

The invention relates to a fire extinguisher comprising a container containing an extinguishing agent and a holder for a propellent gas cartridge for filling the container containing the extinguishing agent with propellent gas, as well as an actuating mechanism which has an actuating member for actuating a resiliently prestressed valve pin which is rigidly connected to a push rod for opening the propellent gas cartridge and controls a valve for release of the extinguishing agent which is acted upon by the propellent gas, wherein before the fire extinguisher is first put into operation a safety element is arranged between the actuating mechanism and the spring-loaded valve pin for arresting the actuating member and the safety element can be removed from the space between the actuating member and the valve pin to release the arresting action.

Fire extinguishers of that kind are known. In the known fire extinguishers of that kind, before the fire extinguisher is put into operation, the safety element firstly has to be removed and then the actuating mechanism has to be acted upon for a short time so that the propellent gas cartridge is opened and the container containing the extinguishing agent is filled with propellent gas. During that time the propellent gas not only flows into the container but also out of the container as the valve is opened at the same time. For that reason the opening procedure for the propellent gas cartridge should be as short as possible so that, after the propellent gas cartridge is opened, the propellent gas initially only fills the container in which the extinguishing agent is disposed and which is automatically closed by the resiliently prestressed valve pin. It is only in the event of a subsequent second actuation that the extinguishing agent should then be sprayed with the fire extinguisher, under the impulsion of the propellent gas in the container.

In this respect there is the danger that the first actuation procedure lasts too long so that the build-up of pressure achieved in the container is not sufficient to spray the extinguishing agent out of the container, down to a predetermined residual amount. In other words, too much extinguishing agent is left over in the container. That disadvantage should be eliminated.

Furthermore in accordance with a European standard there is now the requirement that, after the fire extinguisher has been armed, the actuating mechanism must initiate the extinguishing process immediately upon first actuation or depression of the actuating mechanism.

The present invention now aims to take account of those requirements. In a fire extinguisher of the kind set forth in the opening part of this specification, in accordance with the invention, that is achieved in that the safety element is of a wedge-shaped configuration and can be withdrawn from the space between the actuating member and the valve pin so that upon withdrawal of the safety element the propellent gas cartridge is automatically opened and the arresting action in respect of the actuating member is removed.

The propellent gas cartridge is opened automatically when the safety element is withdrawn, by virtue of the wedge-shaped configuration thereof. That procedure also takes place in a relatively short period of time as withdrawal of the safety element takes place more or less jerkily by virtue of the resistance force due to the resiliently loaded valve pin and thus no propellent gas is lost to the exterior, and the propellent gas is now utilised exclusively for filling the container.

As the actuating mechanism no longer has to be depressed to open the propellent gas cartridge, but this was implemented by withdrawal of the safety element, the invention also achieves the advantage that, when the actuating mechanism is first depressed, it is possible to begin immediately with the extinguishing procedure for there will generally be at least between 2 and 3 seconds between arming and depressing the actuating mechanism, a time which is sufficient for completely filling the container with propellent gas. This therefore also takes account of the second requirement involved.

Preferably the safety element has a ring with which it can be withdrawn. That ring virtually challenges the user of the fire extinguisher to pull the safety element out before putting the extinguisher into operation.

Desirably the safety element is markedly contrasted in terms of colour, in relation to the fire extinguisher.

The invention will now be described in greater detail by means of an embodiment and with reference to the accompanying drawing. The drawing shows the most important parts of the fire extinguisher partly in section without the container for accommodating the extinguishing agent. That container is screwed on to the screwthread 10 of a shaped portion enclosing the actuating mechanism 12. An O-ring 14 serves to seal off the screwed-on container. A holder 16 for a propellent gas cartridge 18 is screwed into the shaped portion of the actuating mechanism. The propellent gas cartridge 18 can be a commercially available carbon dioxide cartridge.

The actuating mechanism includes the one-piece shaped portion of plastic material, which has a handle 20. Disposed in the shaped portion 12 is a valve pin 22, at the lower end of which is rigidly arranged a push rod 24 for breaking open a bursting disc (not shown in greater detail) of the propellent gas cartridge 18 . The valve pin 22 which is mounted displaceably in the shaped portion 12 is prestressed upwardly by means of a spring 26, as shown, so that a valve seal 28 which is in the form of an O-ring and which surrounds the valve pin 22 and which is held in a groove in the valve pin engages into a valve seat in the form of a bore. This closed condition of the valve is illustrated in the drawing. Beneath the valve seat the bore is enlarged at 30 and is open by way of passages 32 in the holder 16 to the interior of the container (not shown).

Above the valve seat the bore has a narrowing or tapering portion 34 which surrounds the valve pin 22 at a spacing. Shoulders 38 on the valve pin 22 guide the valve pin in the bore. The reduced portion 34 of the bore is connected to an outlet opening 40 for spraying the extinguishing agent disposed in the container when the valve seal 28 engages into the enlarged bore portion 32, coming away from the valve seat in a downward direction, and thus opens the valve.

Arranged on the shaped portion 12 is an actuating lever 44 which is pivotable about the axis 42 and which has an actuating member 46 with which the valve pin 22 can be urged downwardly into the open valve position against the force of the spring 26, in which case at the same time the push rod 24 moves into the propellent gas cartridge 18.

Before the fire extinguisher is first put into operation, disposed between the actuating member 46 and the valve pin 22 is a wedge-shaped safety element 48 having a ring 50 with which it can be withdrawn from the space between the actuating member 46 and the valve pin 22. As the end of the safety element 48 which is opposite to the ring is thicker and decreases in its thickness towards the valve pin 22, on the one hand the safety element 48, after release of a bar or tongue 52 at the end opposite to the ring 50, can be relatively easily withdrawn, in which case release of the tongue or bar 52 is easily effected by the user of the fire extinguisher pulling with a jerk on the ring 50, and on the other hand the thick end of the wedge-shaped safety element causes the valve pin 22 to be urged downwardly against the spring 26 to such an extent that the push rod 24 pierces the bursting disc of the propellent gas cartridge 18.

By virtue of the jerky movement which is produced by virtue of the tongue or bar 52, upon withdrawal of the safety element 48, it is only for a short time that the valve seal 28 opens the flow path to the outlet 40 for the propellent gas which can flow into the container interior by way of lateral bores 54 in the holder 16, even when the valve is closed.

In order to make it easier for the safety element 48 to be withdrawn towards the right in the drawing, the valve pin is rounded off at its upper end.

After removal of the safety element 48 it is already possible to effect extinguishing with the fire extinguisher, with the first pressure applied to the actuating lever 44. The actuating member 46 then directly presses the valve pin 22 downwardly so that the valve 28 is opened and the propellent gas can spray the extinguishing agent by way of 32, 30, 34 and 40.

The safety element 48 is supported displaceably in the shaped portion of the actuating mechanism on both sides, in which respect the guide means of the shaped portion and the lateral sliding surfaces of the safety element 48 can also extend in the same direction in a wedge-shaped configuration in suitable manner towards each other.

What is claimed is:

1. A fire extinguisher comprising a container containing an extinguishing agent and a holder (16) for a propellent gas cartridge (18) for filling the container containing the extinguishing agent with propellent gas, as well as an actuating mechanism (12) which has an actuating member (46) for actuating a resiliently prestressed valve pin (22) which is rigidly connected to a push rod (24) for opening the propellent gas cartridge (18) and controls a valve for release of the extinguishing agent which is acted upon by the propellent gas, wherein before the fire extinguisher is first put into operation a safety element (48) is arranged between the actuating mechanism (46) and the spring-loaded valve pin (22) for arresting the actuating member (46) and the safety element (48) can be removed from the space between the actuating member (46) and the valve pin (22) to release the arresting action, characterised in that the safety element (48) is of a wedge-shaped configuration and can be withdrawn from the space between the actuating member and the valve pin so that upon withdrawal of the safety element (48) the propellent gas cartridge (18) is automatically opened and the arresting action in respect of the actuating member (46) is removed.

2. A fire extinguisher according to claim 1 characterised in that the safety element (48) has a ring (50) at which it can be withdrawn.

3. A fire extinguisher according to claim 1 characterised in that the safety element is contrasted in colour with respect to the fire extinguisher.

4. A fire extinguisher according to claim 1 characterised in that a restraint (52) has to be overcome when withdrawing the safety element (48).

* * * * *